US007601006B2

(12) United States Patent
Christoffersen

(10) Patent No.: US 7,601,006 B2
(45) Date of Patent: Oct. 13, 2009

(54) WIND TURBINE, A HIGH CURRENT CONNECTOR AND USES THEREOF

(75) Inventor: Viggo Kofod Christoffersen, Ringkobing (DK)

(73) Assignee: Vestas Wind Systems A/S (DK)

( * ) Notice: Subject to any disclaimer, the term of this patent is extended or adjusted under 35 U.S.C. 154(b) by 0 days.

(21) Appl. No.: 12/137,268

(22) Filed: Jun. 11, 2008

(65) Prior Publication Data

US 2008/0293260 A1 Nov. 27, 2008

Related U.S. Application Data

(63) Continuation of application No. PCT/DK2005/000785, filed on Dec. 12, 2005.

(51) Int. Cl.
*H01R 41/00* (2006.01)

(52) U.S. Cl. ..... 439/32; 439/512; 439/840; 439/843

(58) Field of Classification Search ..... 439/23, 439/32, 841, 511, 512, 840, 843
See application file for complete search history.

(56) References Cited

U.S. PATENT DOCUMENTS

| | | | | |
|---|---|---|---|---|
| 4,013,329 | A | 3/1977 | Hugin | |
| 4,111,511 | A | 9/1978 | Bolin | |
| 5,401,173 | A | 3/1995 | Grandchamp et al. | |
| 5,997,367 | A | 12/1999 | Nowak et al. | |
| 6,304,002 | B1 * | 10/2001 | Dehlsen et al. | 290/1 C |
| 7,429,199 | B2 * | 9/2008 | Burgess | 439/841 |
| 2008/0080946 | A1 * | 4/2008 | Livingston et al. | 411/54.1 |
| 2009/0008945 | A1 * | 1/2009 | Helle et al. | 290/55 |

FOREIGN PATENT DOCUMENTS

EP 0 757 410 A2 5/1997

OTHER PUBLICATIONS

International Search Report, Aug. 30, 2006, 3 pages.

* cited by examiner

*Primary Examiner*—Neill Abrams
*Assistant Examiner*—Phuong Nguyen
(74) *Attorney, Agent, or Firm*—St. Onge Steward Johnston & Reens LLC

(57) ABSTRACT

The invention relates to a wind turbine connected to a utility grid or another electric load. The wind turbine comprises at least one electric generator generating a high current, at least one substantially inflexible conductor conducting the current, a high current connector including a housing capable of conducting the current, where the housing comprises two or more openings for accommodating at least two conductor ends of the conductor. The wind turbine is characterized in that, the openings of the high current connector comprise one or more connections for providing an electric connection between the conductor ends and the housing, the connections are configured for allowing substantially unrestricted movements of the conductor ends in the conductors longitudinal direction. The invention further relates to a high current connector and uses hereof.

43 Claims, 5 Drawing Sheets

WIND TURBINE, A HIGH CURRENT CONNECTOR AND USES THEREOF

CROSS-REFERENCE TO RELATED APPLICATIONS

The present application is a continuation of pending International patent application PCT/DK2005/000785, filed Dec. 12, 2005, which designates the United States, the content of which is incorporated herein by reference.

FIELD OF THE INVENTION

The invention relates to a wind turbine connected to a utility grid or another electric load comprising an electric generator generating a high current, a substantially inflexible conductor conducting the current, a high current connector including a housing capable of conducting the current, the housing comprising two or more openings for accommodating at least two conductor ends of the conductor and a high current connector comprising a housing capable of conducting an electrical current, the housing comprising two or more openings for accommodating at least two conductor ends of a substantially inflexible conductor and uses hereof.

BACKGROUND OF THE INVENTION

A wind turbine known in the art comprises a tapered wind turbine tower and a wind turbine nacelle positioned on top of the tower. A wind turbine rotor with a number of wind turbine blades is connected to the nacelle through a low speed shaft, which extends out of the nacelle front as illustrated on FIG. 1.

When conducting current through a conductor the conductors temperature is raised. When the temperature is raised the conductor expands and particularly the conductors length will be increased. When the temperature drops again, the conductor contracts accordingly.

If the conductor is a cable comprising a number of twisted conductors, the "windings" of the conductors to some degree will be able to absorb this motion, but if the cable is a solid core conductor of a substantial diameter, this movement of the cable can be very forceful and therefore potentially very damaging.

If a conductor connects two fixed electrical components, this extension and contraction of the cable can either lead to the cable bending or applying considerable strain to the components. This is of course disadvantageous, in that it can damage the cables insulation, it can damage the components or otherwise create undesired scenarios, which might lead to short circuits or other kinds of damage.

For instance a wind turbine is provided with one or more generators to transform the energy of the wind to electrical current. A wind turbine generator known in the art among other things comprise a rotor and a stator. E.g. through a gear the wind turbine blades are connected to the rotor in the generator. When the blades rotate the rotor is thereby also rotated and high current electricity is produced.

To lead the current from the electromagnets of the rotor, the rotor shaft is provided with a number of slip rings, which are connect to their respective rotor coils by a number of relatively thick solid core conductors. These conductors are usually made as solid rods with a diameter of up to 10 mm or more, and they are typically made of copper or another material with excellent current conducting qualities. The rotor shaft on the other hand is usually made of steel, making it able to withstand the large loads it is exposed to.

The coefficient of expansion of the conductors is therefore usually larger than the shafts coefficient of expansion and e.g. due to loss, the conductors becomes very hot during use. This means that the conductors extend and contracts more than the shaft, which will lead to relative motion between the cables and the shaft or other fixed neighbouring components, which do not extend correspondingly.

This relative motion is very disadvantageous, in that the cables insulation might be damaged due to rubbing or the cables might break lose, which in worst case can lead to short circuits, which can be very damaging to the cables, the generator or other components.

An object of the invention is therefore to provide for a technique for handling the extension and contraction of high current conductors, thereby reducing the risk of damage to the conductors or other components.

Especially it is an object of the invention to provide technique for handling the extension and contraction of high current conductors in a wind turbine.

SUMMARY OF THE INVENTION

The invention provides for a wind turbine connected to a utility grid or another electric load. The wind turbine comprises at least one electric generator generating a high current, at least one substantially inflexible conductor conducting the current, a high current connector including a housing capable of conducting the current, where the housing comprises two or more openings for accommodating at least two conductor ends of the conductor, characterized in that, the openings comprise one or more connection means for providing an electric connection between said conductor ends and said housing, said connection means configured for allowing substantially unrestricted movements of the conductor ends in the conductors longitudinal direction.

Modern wind turbines produces large amounts of high current electricity, and because of the very limited space in a wind turbine and particularly in the nacelle moving, extending, contracting or bending high current conductors is very undesirable, in that—because of the limited space—the risk of the conductors insulation being damaged or other problems occurring is relatively high.

Furthermore the consequences of damage in a wind turbine is particularly severe, in that the damage is very expensive to repair because of the difficult access and because of the often remote locations e.g. off-shore.

Providing the high current connector with connection means enabling the conductors ends to move substantially freely lengthwise is therefore advantageous, in that it provides for a way to control the movement of the conductor, originating from temperature variations in the conductor, hereby reducing or eliminating the risk of the conductor bending or straining the conductors attachment points or the conductor itself in an undesirable manner.

In an aspect of the invention, said connection means are separate from said housing.

By making the connection means separate from the housing it is possible to make the connection means as relatively inexpensive wearing parts. Furthermore it is hereby possible to design the connection between the conductor and the housing in a way, which only restricts the conductors ability to move freely marginally.

In an aspect of the invention, said one or more connection means are formed circular and providing a plurality of current conducting contact points onto said conductor ends.

Forming the connection means circular is advantageous, in that it enables current conduction all the way around a round conductor and providing the connection means with a plurality of current conducting contact points is advantageous, in that it provides the connection means with good current conducting qualities.

In an aspect of the invention, said one or more connection means are circular coil springs.

A coil spring is relatively easy to manufacture and its current conducting qualities can be controlled very specifically through the choice of material, thread diameter and number of windings, which defines the number of contact points. This is advantageous, in that it hereby is possible to dimension the connection mean to its specific use hereby reducing costs.

Furthermore, the coil spring makes contact with the conductor in the coils transverse direction. This makes the conductor tangent to the spring, where the spring connects with the conductor in a soft curve. This is advantageous, in that it hereby is possible for the conductor to move substantially unrestricted through the connector, without damaging or displacing the connection means.

In an aspect of the invention, said coil springs are circular canted coil springs.

Using circular canted coil springs as connection means is advantageous, in that it hereby is possible to use a larger thread for making the spring and thereby be able to conduct a higher current, without increasing the force by which the spring presses against the conductor at the contact points. In other words by using a canted spring, it is possible to conduct a higher current, without restricting the conductors ability to move freely lengthwise considerable.

In an aspect of the invention, said circular coil springs have characteristics ensuring that said springs are annealed before a defined current level is reached.

Most electrical components can only endure currents up to a certain level before they get to hot and break down or are damaged otherwise. By designing the spring in such a way that the current heats the spring to a point where it is anneals before a certain current level is reached, the spring will more or less collapse, hereby reducing the connectors ability to conduct current.

This is advantageous, in that it hereby—in a simple and very inexpensive way—is possible to use the connector as a fuse or a safety device, which can protect the components it is attached between from damaging overloads.

In an aspect of the invention, said openings are circular holes.

Conductors are always or most often round, making it advantageous to form the openings as circular holes.

In an aspect of the invention, said circular holes are through holes.

Making the holes through holes is advantageous, in that it hereby is possible for the conductor to extend freely, without facing any restrictions such as the bottom of the holes.

In an aspect of the invention, said circular through holes centrelines are parallel.

Making the centrelines parallel is advantageous, in that it simplifies the manufacturing process of the housing. Furthermore, the conductors on which the connector is to be used usually runs more or less straight.

In an aspect of the invention, said circular through holes centrelines are displaced.

Displacing the openings is advantageous, in that the conductor ends can extend freely out of each of the holes, providing the connector with no limitations regarding the magnitude of the conductor extension.

In an aspect of the invention, said circular through holes are concentric.

Making the holes concentric is advantageous, in that it hereby provides for a simple connector design e.g. in form of a tube, where the conductor ends are mounted from opposite sides leaving space in the middle for extension of the conductors.

In an aspect of the invention, said openings are substantially uniform.

Uniform holes provides for a simple housing design, hereby reducing the manufacturing costs.

In an aspect of the invention, said openings comprise at least one groove.

Hereby is achieved an advantageous embodiment of the invention.

In an aspect of the invention, said one or more connection means are disposed in said at least one groove.

Disposing the connection means in the grooves is advantageous, in that it hereby is possible to fixate the connection means in a simple and inexpensive manner.

In an aspect of the invention, said housing are provide with cooling means such as fins or similar surface enlarging features for giving off heat.

Conducting high currents can produce much heat. Providing the housing with cooling means is advantageous, in that it hereby is possible to make the housing smaller without raising the housings temperature during use.

In an aspect of the invention, said cooling means are providing said housing with an asymmetrical shape.

Making the cooling means provide the housing with an asymmetrical shape is advantageous, it that it hereby is possible to ensure correct mounting and to visually control that the connector is correctly mounted.

In an aspect of the invention, said housing and said connection means are made of copper or a copper alloy suitable for conducting high currents.

Copper or a copper alloy has excellent high currents conducting capabilities and is at the same time relatively inexpensive and easy to machine. It is therefore advantageous to make the housing and the connection means of this material.

In an aspect of the invention, said high current is current between 100 A and 1500 A, preferably between 400 A and 1200 A.

Hereby is achieved an advantageous embodiment of the invention.

In an aspect of the invention, said openings comprise guiding means for guiding said conductor ends into said openings.

Providing the openings with guiding means are advantageous, in that enables a simple mounting procedure.

In an aspect of the invention, said openings comprise a fillet or a chamfer around the edges on the entry of said openings.

Forming a fillet or a chamfer around the entry of the openings is advantageous, in that it is a simple and inexpensive way of providing the openings with guiding means.

In an aspect of the invention, said guiding means are positioned on opposite sides of said housing making said conductor ends extends into in said housing from opposite sides.

Conductors most often connect electric components by running straight in more or less one direction. It is therefore advantageous that the position of the guiding means enables that the conductor ends are mounted from opposite sides.

In an aspect of the invention, said substantially inflexible conductor connects components in a synchronous or an asynchronous wind turbine generator.

Synchronous or asynchronous wind turbine generators have many rotating parts which need to be connected by means of high current conductors. Because they rotate, any bending of the conductors could very easily damage the conductors insulation and lead to a possible short circuit. It is therefore particularly advantageous to use the connector to connect conductors in a synchronous or an asynchronous wind turbine generator.

In an aspect of the invention, said at least one substantially inflexible conductor is a solid core conductor.

Conductors comprising a plurality of straight or twisted conductors will have a tendency to "absorb" an extension of the individual conductors internally, without straining the cable itself or its connection points. But if a solid core conductor extents it will be much more forceful, in that a solid core conductor of the same capacity as an equivalent twisted conductor will have a much lower module of elasticity making it much more rigid.

It is therefore advantageous to use a high current connector according to the invention to connect solid core conductors.

It should be emphasised that the term "solid core conductor" does not include conductors comprising a plurality of straight or twisted conductors. The term only refers to conductors consisting of only one single solid wire or rod.

The invention further provides for a high current connector. The connector comprises a housing capable of conducting an electrical current, where the housing comprising two or more openings for accommodating at least two conductor ends of a substantially inflexible conductor. The high current connector is characterized in that, the openings comprise one or more connection means for providing an electric connection between the conductor ends and the housing, where the connection means are configured for allowing substantially unrestricted movements of the conductor ends in the conductors longitudinal direction.

Providing high current conductors with connectors, which allows the conductor to move substantially freely lengthwise is advantageous, in that an extension of the conductor could lead to the conductor bending, thereby making the conductors insulation collide or drag against other parts, and hereby damaging the conductor or other components. The connector will relieve the conductor of the possible strain originating from the cooling and heating of the conductor.

In an aspect of the invention, said connection means are separate from said housing.

In an aspect of the invention, said one or more connection means are formed circular and providing a plurality of current conducting contact points onto said conductor ends.

In an aspect of the invention, said one or more connection means are circular coil springs.

In an aspect of the invention, said coil springs are circular canted coil springs.

In an aspect of the invention, said circular coil springs have characteristics ensuring that said springs are annealed before a defined current level is reached.

In an aspect of the invention, said openings are circular holes.

In an aspect of the invention, said circular holes are through holes.

In an aspect of the invention, said circular through holes centrelines are parallel.

In an aspect of the invention, said circular through holes centrelines are displaced.

In an aspect of the invention, said circular through holes are concentric.

In an aspect of the invention, said openings are substantially uniform.

In an aspect of the invention, said openings comprise at least one groove.

In an aspect of the invention, said one or more connection means are disposed in said at least one groove.

In an aspect of the invention, said housing are provide with cooling means such as fins or similar surface enlarging features for giving off heat.

In an aspect of the invention, said cooling means are providing said housing with an asymmetrical shape.

In an aspect of the invention, said housing and said connection means are made of copper or a copper alloy suitable for conducting high currents.

In an aspect of the invention, said high current is current between 100 A and 1500 A, preferably between 400 A and 1200 A.

In an aspect of the invention, said openings comprise guiding means for guiding said conductor ends into said openings.

In an aspect of the invention, said openings comprise a fillet or a chamfer around the edges on the entry of said openings.

In an aspect of the invention, said guiding means are positioned on opposite sides of said housing.

In an aspect of the invention, said at least one substantially inflexible conductor is a solid core conductor.

The invention provides for use of high current connector according to any of claims 23 to 44 for connecting conductors in a wind turbine according to any of claims 1 to 22.

The invention further provides for use of high current connector according to any of claims 23 to 44 as a safety device, which breaks or reduces the conducted current before a defined current level is reached.

The high current connector for connecting conductors is very simple designed and therefore very inexpensive. Providing the high current connector with fuse-like qualities is therefore a simple and inexpensive way of protecting the components the conductor connects from possibly very damaging overloads.

BRIEF DESCRIPTION OF THE DRAWINGS

The invention will be described in the following with reference to the figures in which FIG. 1. illustrates a large modern wind turbine known in the art, as seen from the front.

DETAILED DESCRIPTION OF THE INVENTION

Figure 1:
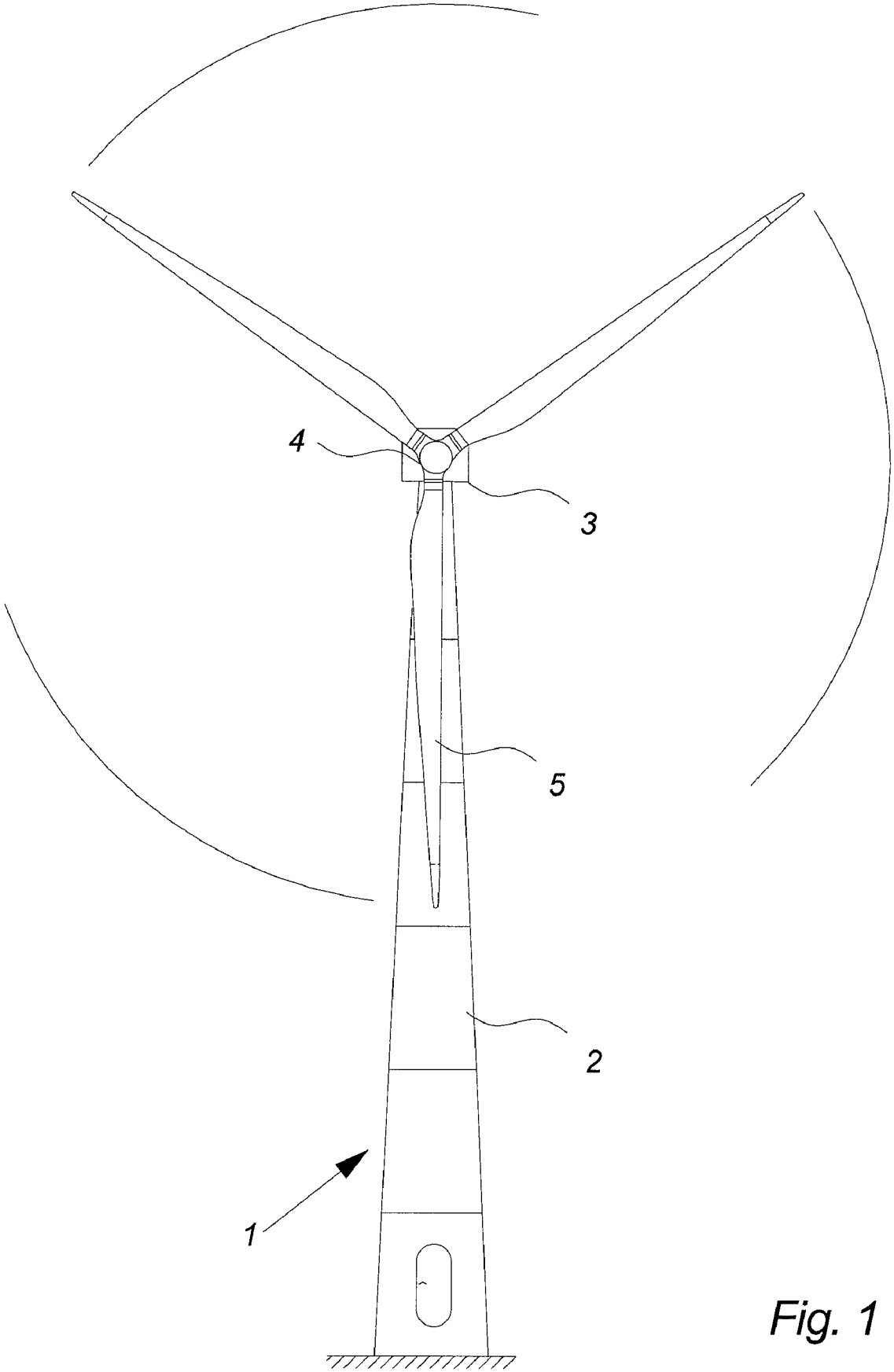

FIG. 1 illustrates a modern wind turbine 1, comprising a tower 2 and a wind turbine nacelle 3 positioned on top of the tower 2. The wind turbine rotor 4, comprising three wind turbine blades 5, is connected to the nacelle 3 through the low speed shaft which extends out of the nacelle 3 front.

Figure 2:
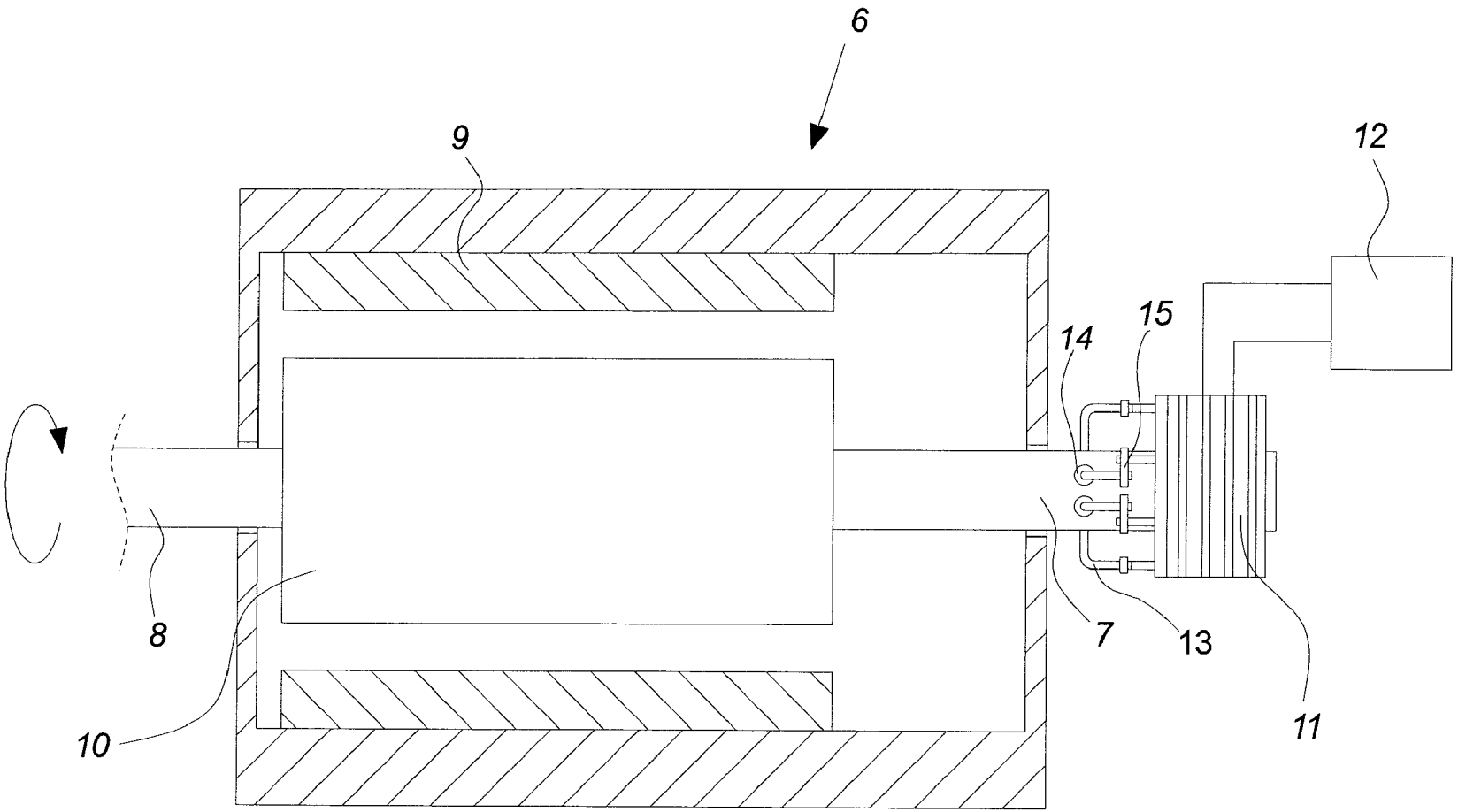
FIG. 2 illustrates a cross section of a wind turbine generator as seen from the side.

FIG. 2 illustrates a cross section of a wind turbine generator 6 as seen from the side. The generator 6 is usually positioned substantially horizontally in the nacelle 3 where the generator shaft 7 in the drive end 8 is connected to the wind turbine rotor 4 e.g. through a gear.

The generator 6 comprises a fixed stator part 9 comprising a number of e.g. copper coils and a rotor part 10 comprising a number of magnets connected to the shaft 7. The principle of the generator 6 is, that when the rotor part 10 rotates, due to wind load on the wind turbine blades 5, the magnets on the rotor part 10 induces a current in the coils of the stator part 9 and in double feed induction generators 6 also the rotor will produce energy. The magnets of the rotor part 10 could be permanent magnets, but among other reasons to optimize the output of the generator 6, the magnets of the rotor 10 in a wind turbine generator 6 are electromagnets. In order for these electromagnets to function, they have to be connected to a power supply which in this case is a utility grid 12 and the produced current has to be removed from the rotating rotor 10 and fed to the utility grid 12. This is normally done through a number of slip rings 11 mounted on the shaft 7. In this embodiment of a generator 6 the rotor 10 comprises four electromagnets from out of which two conductors 13 extend. The conductors 13 are made as solid core copper rods, which through the centre of the hollow shaft 7, are lead out of the generator 6. Outside the generator 6 the conductors 13—either through holes 14 in the shaft 7 or through the opening in the end of the hollow shaft 7—are lead outside the shaft 7 and finally connected to the slip rings 11. In another embodiment of the invention the slip rings 11 could also be positioned in close proximity of the rotor 10 making the conductors 13 relatively short.

The shaft 7 has to transfer the massive load from the rotating blades 5 to the generator 6 and is therefore made of a strong and rigid material such as steel. The conductors have to conduct very high currents on up to e.g. 1500 A and are therefore made of a copper alloy with excellent current conducting qualities. But copper and steel has different coefficients of expansion making the conductors 13 and the shaft 7 move relatively to each other, when they expand or contract. This relative motion are further amplified by the fact the conductors become very hot when in use. So even though the conductors 13 are cooled by the air, when the rotor 10 rotates, they will still be exposed to greater temperature variations than the shaft 7.

To prevent the conductors 13 from moving radial and/or to prevent the strain from the axial expansion or contraction from breaking the conductors 13 lose or in other ways harm the conductors 13, the generator 6 or other components in the nacelle 3, each conductor 13 are provided with a high current connector 15.

Figure 3:
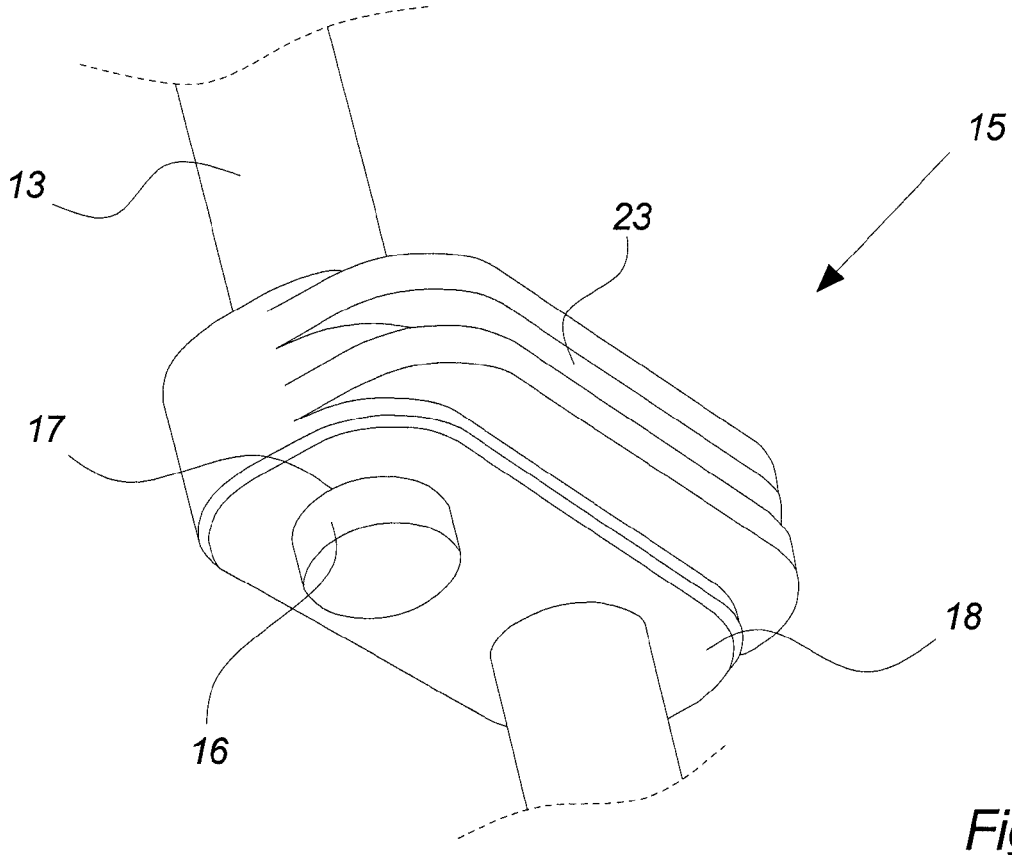
FIG. 3 illustrates a high current connector mounted on a conductor as seen in perspective.

FIG. 3 illustrates a high current connector 15 mounted on a conductor 13 as seen in perspective. In this embodiment of the invention the two conductor ends 16 extends all the way through the connector 15 and the two ends 16 are mounted in separate individual openings 17 in the connector 15 from opposite sides.

Figure 4:
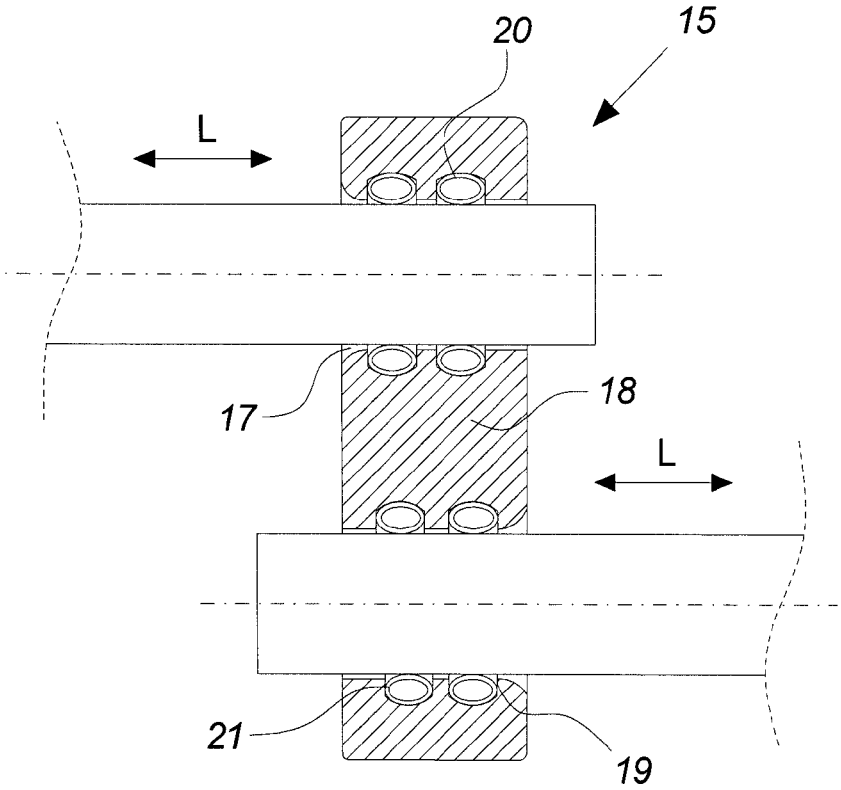
FIG. 4 illustrates a cross section of a high current connector mounted on a conductor as seen from the side.

FIG. 4 illustrates a cross section of a high current connector 15 mounted on a conductor 13 as seen from the side.

In this embodiment of the invention the openings 17 in the connector housing 18 are displaced making the conductor ends 16 extend through the housing in separate openings 17. Each of the two openings 17 are provided with two grooves 19 in which connection means 20 are positioned.

The connection means 20 establishes a current conducting connection between the conductor ends 16 and the housing 18. The connection means 20 could be brushes, wires, circular coil springs 21 or other flexible means capable of conducting high currents, substantially without restricting the conductor ends 16 ability to move freely in the conductors 13 longitudinal direction L.

Figure 5:
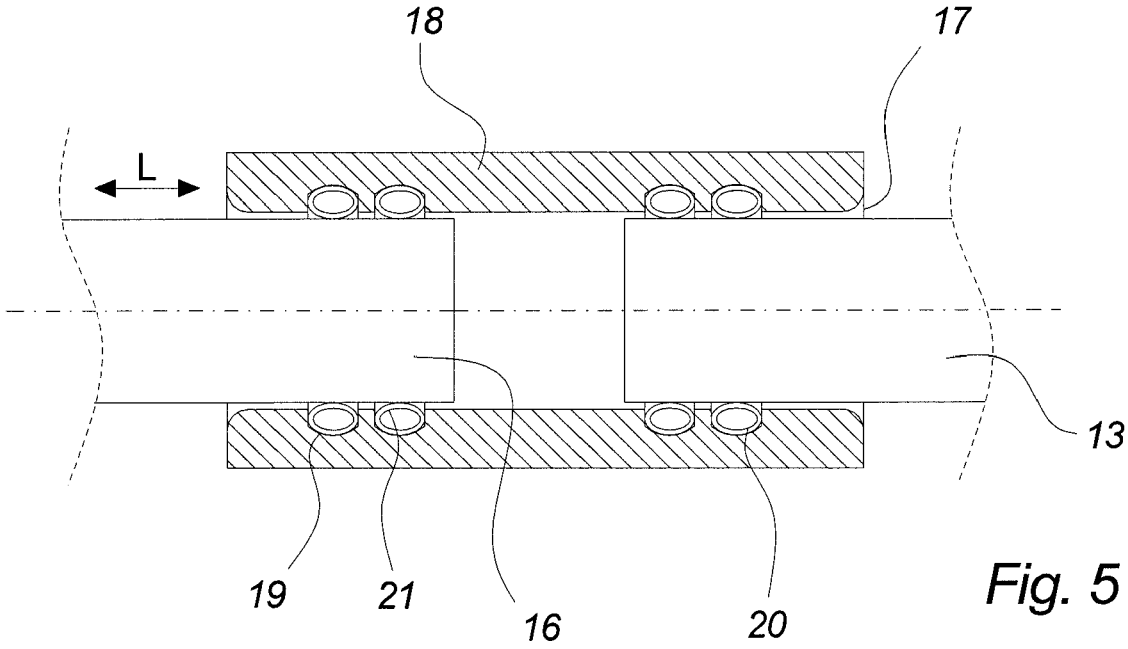
FIG. 5 illustrates a cross section of another embodiment of a high current connector as seen from the side.

FIG. 5 illustrates a cross section of another embodiment of a high current connector 15 as seen from the side. In this embodiment of the invention the openings 17 are concentric, providing the housing 18 with only one hole. Further, the openings are uniform in that they have equal diameter, but in another embodiment of the invention the openings could be of different shape or diameter.

Figure 6:
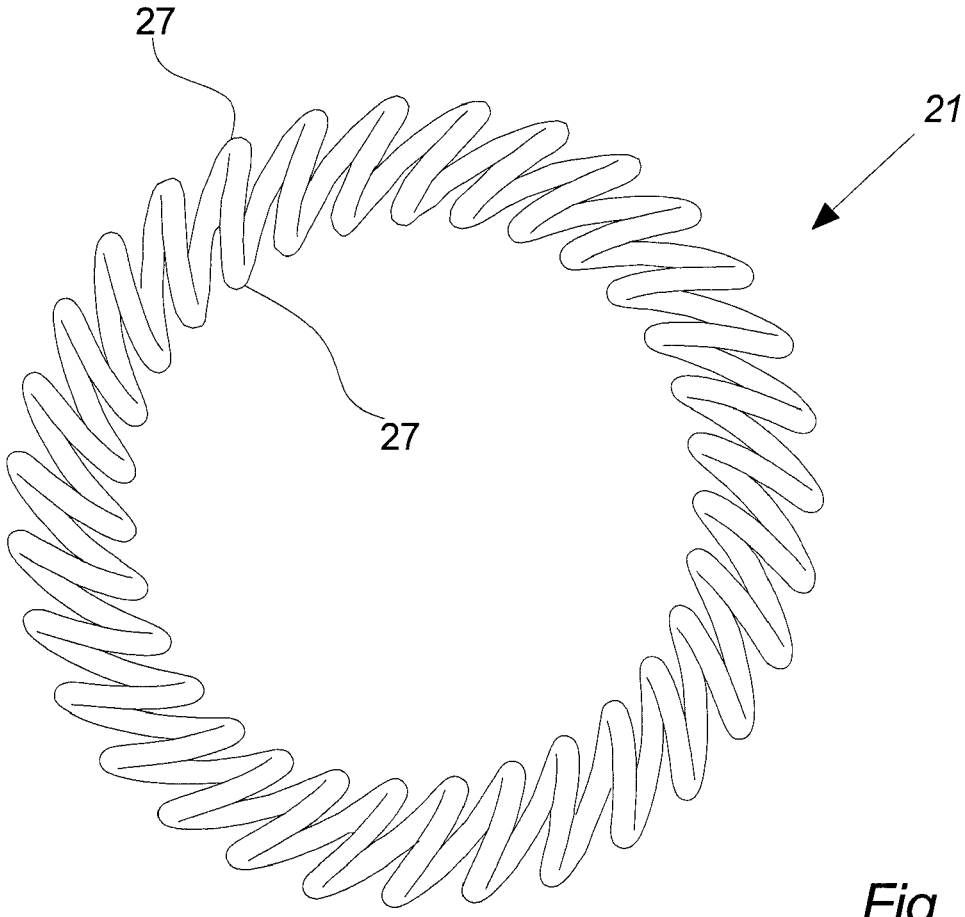
FIG. 6 illustrates a an embodiment of a connection mean in form of a circular coil spring as seen from the side.

FIG. 6 illustrates an embodiment of a connection mean 20 in form of a circular coil spring 21 as seen from the side. In this embodiment of the invention the windings of the spring are canted, providing the spring with springy qualities, not only in the direction of the windings but also so in the transverse direction. The spring enables a plurality of contact points 27 both to the housing 18 and to the conductor ends 16.

Compared to the conductor 13 the spring 21 has a relatively little thread diameter, and even though the windings of the spring offers a large number of single conductors between the housing 18 and the conductor 13, it still enables that the spring 21 anneals if the conducted current reaches a certain level. The higher the current becomes the hotter the springs 21 becomes and when a certain level is reached the spring is annealed, whereby the characteristics of the spring 21 changes, making it press less hard against the conductor 15. This will reduce the contact to the conductor, whereby less current can be conducted. This feature provides the high current connector 15 with a fuse-like quality, which can protect e.g. a generator 6 or other components against a damaging current overload.

Figure 7:
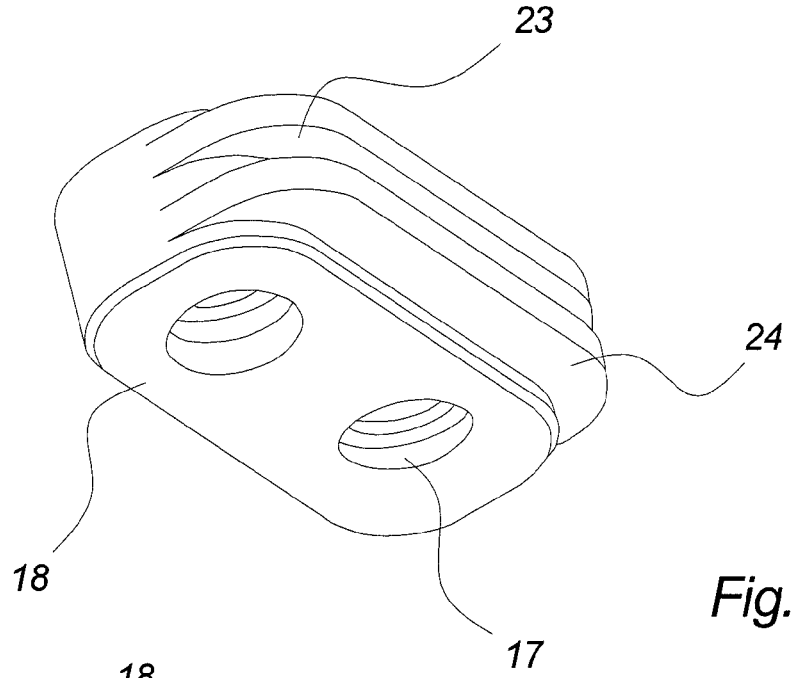
FIG. 7 illustrates an embodiment of a housing for a high current connector as seen in perspective.

FIG. 7 illustrates an embodiment of a housing 18 for a high current connector 15 as seen in perspective. In this embodiment of the invention the housing 18 is provided with cooling means 23 in form of two fins 24 extending from one of the housings 18 sides. This particular design of the cooling means 23 does also provide the housing with an asymmetrical design ensuring that correct orientation of a mounted high current connection 15 can be visually detected.

In another embodiment of the invention the cooling means 23 could be fins 24 provided on more or other sides of the housing 18 or it could be other surface enlarging features such as holes, surface tracks or separate attached fins.

Figure 8:
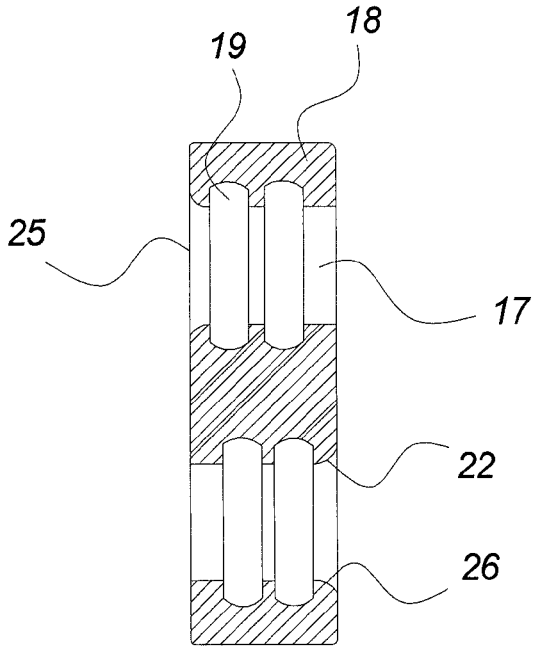
FIG. 8 illustrates a cross section of the same embodiment of a housing a shown in FIG. 7 as seen from the side.

FIG. 8 illustrates a cross section of the same embodiment of a housing 18 a shown in FIG. 7 as seen from the side. In this embodiment of the invention each opening 17 is provided with two grooves 19 for disposing connection means 20, but in another embodiment the openings 17 could comprise only one groove 19 or more than two e.g. three grooves 19.

At the entry 25 of the openings 17 the housing is provided with guiding means 22 in that the edge between the housing surface and the opening is provided with a fillet, ensuring that the connector 15 can easily be mounted on a conductor 13.

Figure 9:
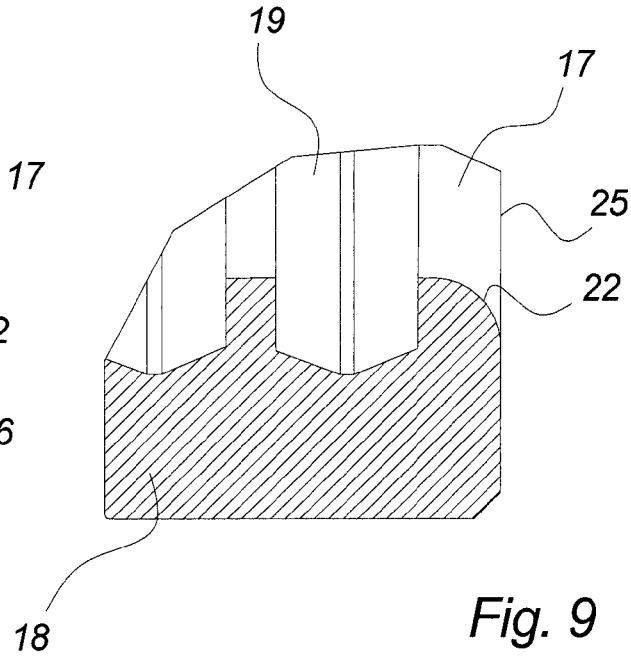
FIG. 9 illustrates an enlarged part of the cross section shown in FIG. 8.

FIG. 9 illustrates an enlarged part of the cross section shown in FIG. 8. In this embodiment of the invention the grooves 19 are more or less formed as rectangular cut-outs, where the bottoms are tapering towards the middle of the groove 19, but in another embodiment of the invention the grooves 19 could have other shapes such as a semicircular shape.

The invention has been exemplified above with reference to specific examples of high current connectors 15 for conductors 13 in a wind turbine 1. However, it should be understood that the invention is not limited to the particular examples described above but may be designed and altered in a multitude of varieties within the scope of the invention as specified in the claims.

LIST

1. Wind turbine
2. Tower
3. Nacelle
4. Rotor
5. Blade
6. Generator
7. Shaft
8. Drive end
9. Stator
10. Rotor
11. Slip ring
12. Utility grid
13. Conductor
14. Hole in shaft
15. High current connector
16. Conductor end
17. Opening
18. Housing
19. Groove
20. Connection means
21. Circular coil spring
22. Guiding means
23. Cooling means
24. Fin
25. Opening entry
26. Fillet
27. Contact point
L. Longitudinal direction of conductor

What is claimed is:

1. A wind turbine connected to a utility grid or another electric load comprising at least one electric generator generating a high current, at least one substantially inflexible conductor conducting said current, a high current connector including a housing capable of conducting said current said housing comprising two or more openings for accommodating at least two conductor ends of said conductor, wherein said openings comprise one or more contact terminal(s) for providing an electric connection between said conductor ends and said housing, said connection means configured for allowing substantially unrestricted movements of the conductor ends in said conductors longitudinal direction, wherein said at least one substantially inflexible conductor is a solid core conductor and wherein said one or more connection means are formed circular and providing a plurality of current conducting contact points onto said conductor ends.

2. The wind turbine according to claim 1, wherein said contact terminal(s) are separate from said housing.

3. The wind turbine according to claim 1, wherein said openings are substantially uniform.

4. The wind turbine according to claim 1, wherein said housing and said connection means are made of copper or a copper alloy suitable for conducting high currents.

5. The wind turbine according to claim 1, wherein said high current is current between 100 A and 1500 A, preferably between 400 A and 1200 A.

6. The wind turbine according to claim 1, wherein said substantially inflexible conductor connects components in a synchronous or an asynchronous wind turbine generator.

7. The wind turbine according to claim 1, wherein said openings comprise at least one groove.

8. The wind turbine according to claim 7, wherein said one or more contact terminal(s) are disposed in said at least one groove.

9. The wind turbine according to claim 1, wherein said housing are provide with cooling means such as fins or similar surface enlarging features for giving off heat.

10. The wind turbine according to claim 9, wherein said cooling means are providing said housing with an asymmetrical shape.

11. The wind turbine according to claim 1, wherein said one or more contact terminal(s) are circular coil springs.

12. The wind turbine according to claim 11, wherein said coil springs are circular canted coil springs.

13. The wind turbine according to claim 11, wherein said circular coil springs have characteristics ensuring that said springs are annealed before a defined current level is reached.

14. The wind turbine according to claim 1, wherein said openings comprise guiding means for guiding said conductor ends into said openings.

15. The wind turbine according to claim 14, wherein said openings comprise a fillet or a chamfer around the edges on the entry of said openings.

16. The wind turbine according to claim 14, wherein said guiding means are positioned on opposite sides of said housing.

17. The wind turbine according to claim 1, wherein said openings are circular holes.

18. The wind turbine according to claim 17, wherein said circular holes are through holes.

19. The wind turbine according to claim 17, wherein said circular through holes centrelines are parallel.

20. The wind turbine according to claim 17, wherein said circular through holes centrelines are displaced.

21. The wind turbine according to claim 17, wherein said circular through holes are concentric.

22. A high current connector for wind turbine, said connector comprising:

a housing conducting an electrical current;

said housing comprising two or more openings for accommodating at least two conductor ends of a substantially inflexible conductor, wherein said openings comprise one or more contact terminal(s) for providing an electric connection between said conductor ends and said housing, said one or more contact terminal (s) configured for allowing substantially unrestricted movements of the conductor ends in said conductors longitudinal direction, wherein said at least one substantially inflexible conductor is a solid core conductor and wherein said one or more one or more contact terminal (s) are formed circular and providing a plurality of current conducting contact points onto said conductor ends.

23. The high current connector according to claim 22, wherein said openings are substantially uniform.

24. The high current connector according to claim 22, wherein said housing and said contact terminal(s) are made of copper or a copper alloy suitable for conducting high currents.

25. The high current connector according to claim 22, wherein said high current is current between 100 A and 1500 A, preferably between 400 A and 1200 A.

26. Use of high current connector according to claim 22, for connecting conductors in a wind turbine.

27. Use of high current connector according to claim 22 as a safety device, which breaks or reduces the conducted current before a defined current level is reached.

28. The high current connector according to claim 22, wherein said housing are provide with cooling means such as fins or similar surface enlarging features for giving off heat.

29. The high current connector according to claim 28, wherein said cooling means are providing said housing with an asymmetrical shape.

30. The high current connector according to claim 22, wherein said contact termninal(s) are separate from said housing.

31. The high current connector according to claim 30, wherein said openings comprise at least one groove.

32. The high current connector according to claim 31, wherein said contact terminal(s) are disposed in said at least one groove.

33. The high current connector according to claim 22, wherein said contact terminal(s) are circular coil springs.

34. The high current connector according to claim 33, wherein said coil springs are circular canted coil springs.

35. The high current connector according to claim 33, wherein said circular coil springs have characteristics ensuring that said springs are annealed before a defined current level is reached.

36. The high current connector according to claim 22, wherein said openings comprise guiding means for guiding said conductor ends into said openings.

37. The high current connector according to claim 36, wherein said openings comprise a fillet or a chamfer around the edges on the entry of said openings.

38. The high current connector according to claim 36, wherein said guiding means are positioned on opposite sides of said housing.

39. The high current connector according to claim 22, wherein said openings are circular holes.

40. The high current connector according to claim 39, wherein said circular holes are through holes.

41. The high current connector according to claim 39, wherein said circular through holes centrelines are parallel.

42. The high current connector according to claim 39, wherein said circular through holes centrelines are displaced.

43. The high current connector according to claim 39, wherein said circular through holes are concentric.

* * * * *